United States Patent [19]

Maldonado et al.

[11] 4,367,074

[45] Jan. 4, 1983

[54] NOVEL FILTER AID COMPOSITIONS FOR IMPROVING THE LIMITING FILTERABILITY TEMPERATURE AND INHIBITION OF N-PARAFFIN CRYSTAL FORMATION DURING LOW TEMPERATURE OF MIDDLE DISTILLATES

[75] Inventors: Paul Maldonado, St Symphorien d'Ozon; Pierre Etchart, Francheville; Danièle Eber, Lyons, all of France

[73] Assignee: Elf France, Paris, France

[21] Appl. No.: 302,768

[22] Filed: Sep. 16, 1981

[30] Foreign Application Priority Data

Sep. 19, 1980 [FR] France ..... 80 20148

[51] Int. Cl.[3] ..... C10L 1/22

[52] U.S. Cl. ..... 44/62; 44/70; 44/71

[58] Field of Search ..... 44/62, 70, 71; 524/252

[56] References Cited

U.S. PATENT DOCUMENTS

| | | | |
|---|---|---|---|
| 3,373,111 | 3/1968 | Le Suer et al. | 44/71 |
| 3,454,379 | 6/1969 | Isaacson et al. | 44/62 |
| 3,497,334 | 2/1970 | Gee et al. | 44/71 |
| 3,652,239 | 3/1972 | Sweeney et al. | 44/62 |
| 3,862,825 | 1/1975 | Sweeney | 44/62 |
| 4,175,926 | 11/1979 | Wisotsky | 44/62 |

*Primary Examiner*—Charles F. Warren
*Assistant Examiner*—Y. Harris-Smith
*Attorney, Agent, or Firm*—Burgess, Ryan and Wayne

[57] ABSTRACT

Novel filter aid compositions enabling the improvement of limiting filterability temperature and the simultaneous inhibition of settling of the n-paraffin crystals formed at low temperature, comprising a mixture:

of a compound A chosen from among the group of polymers or copolymers having a molecular weight between 500 and 15000 and having a branching rate between 10 and 30 points per 100 carbon atoms;

and a compound B resulting from the condensation of at least one cyclic anhydride and at least one linear N-alkyl-polyamine;

the weight ratio between these constituents A and B being from 1:20 to 20:1.

13 Claims, No Drawings

NOVEL FILTER AID COMPOSITIONS FOR IMPROVING THE LIMITING FILTERABILITY TEMPERATURE AND INHIBITION OF N-PARAFFIN CRYSTAL FORMATION DURING LOW TEMPERATURE OF MIDDLE DISTILLATES

The invention relates to the use of combined filter aids to improve the filterability properties of petroleum distillates, especially certain gasoils. It also concerns distillate compositions, especially gasoils, containing these combined filter aids.

It furthermore concerns the use of these combined filter aids in order to inhibit the settling (or precipitation) of the n-paraffins formed in these distillates, during their prolonged storage at low temperature.

Numerous compounds have been proposed in the state of the art as filter aids to improve the cold storability of middle petroleum distillates. Such compounds may be certain simple or non-polymeric compounds, such as possibly modified paraffins, or salts of alkaline-earth metals. They are most often olefin homopolymers, especially ethylene, with different comonomers, such as vinyl-acetate, alkyl-acrylates, other olefins or di-olefins, as well as certain hydrogenated homo-or copolymers of conjugated di-olefins.

It was thus noted that the efficiency of different recommended filter aids to improve the cold filterability properties of middle petroleum distillates depends largely on the nature of the distillates concerned. It varies, in fact, according to the paraffin content and, above all, according to their distillation range.

Therefore, in the case of cuts known as enlarged gasoil cuts, i.e. distillates whose final distillation point ASTM is above 370° C. and can reach, for example, 390° to 450° C., or cuts called narrow gasoil cuts, i.e. distillates whose initial distillation point ASTM is above 200° C. and can reach, for example, 220° C. to 230° C., it was shown that the efficiency of these various compounds is not sufficient for the gasoils to which they are added to satisfy the specifications required (limiting filterability temperature (LFT) determined according to standard AFNOR M07 042: lower than or equal to −6° C.).

The distillation range of gasoil cuts is generally defined by the ASTM distillation curve:standard ASTM D 86-67 corresponding to standard AFNOR M 07 002/70.

It was, however, noted that the use of this curve for enlarged or narrow cuts did not give a true representation of the said cuts, especially for the heaviest fractions.

It is for this reason that it was often replaced by the distillation curve according to standard ASTM D 1160 obtained under reduced pressure.

Hereinafter in the present application, in certain examples, the gasoils are defined by the classic standard ASTM corresponding to standard AFNOR M 07002/70), this being always the most widely used in industry.

Another limitation to the use of different recommended filter aids to improve the cold filterability properties of middle petroleum distillates is that their association to n-paraffins contained in these distillates induces a reduction in the size of n-paraffin crystals which appear at low temperature.

Although this inhibition mechanism of the crystalline growth is directly related to the improvement of the limiting filterability temperature LFT, of the gasoils, it is generally accompanied by an acceleration of the compact settling of the paraffin microcrystals once formed at the bottom of the storage tanks and diesel motor tanks.

This phenonmenon is often the cause of plugging of pipes in cold weather and blocking of motors when starting by massive clogging of the filters.

It has now been discovered that it is possible to clearly improve the cold filterability properties of the middle petroleum distillates, especially cuts having a final distillation point above 370° C., or an initial distillation point above 200° C., while simultaneously avoiding the accelerated settling of n-paraffin microcrystals formed, by the use of combined filter aids formed of the condensation products of cyclic anhydrides and N-alkyls polyamines and of certain polymers chosen from among the group comprising:

- ethylene polymers or halogenated ethylene polymers;
- copolymers of ethylene and different monomers such as vinyl-acetate or ethyl-hexyl-acrylate;
- hydrogenated butadiene and isoprene copolymers.

The obtention, through the use of filter aids, of a clear improvement of cold filterability properties of enlarged or narrow gasoil cuts to which they are incorporated, constitutes an unexpected result when it is considered that each of these constituents of the combinations of the invention, taken individually, has practically no effect on the filterability properties.

In a general manner, the compositions of the invention comprise a major proportion of a petrol distillate, especially a gasoil, and a proportion sufficient to improve the cold filterability properties of a combination of filter aids formed by constituent (A) and a constituent (B) defined as indicated hereinafter:

Constituent (A) can be chosen from the group:

- ethylene polymers or halogenated ethylene polymers such as chlorinated polyethylene;
- copolymers of ethylene and different monomers such as vinyl-acetate or ethyl-hexyl-acrylate;
- hydrogenated butadiene and isoprene copolymers.

Constituent (A) should have a molecular mass between 500 and 15 000, and preferably from 2 000 to 4 000 and a branching rate, i.e. the number of X radicals between 8 and 30 carbon atoms, X representing a $$-CH_3$$

$$-Cl$$

$$-O-\underset{\underset{O}{\|}}{C}-CH_3$$

$$-\underset{\underset{O}{\|}}{C}-O-CH_2-\underset{\underset{C_2H_5}{|}}{CH}-C_4H_9$$

group, thus respectively:

- if the polymer used is an ethylene polymer or a hydrogenated butadiene and isoprene copolymer, $X=-CH_3$
- if the polymer used is a chlorinated ethylene polymer, $X=-Cl$
- if the polymer used is an ethylene and vinyl-acetate copolymer, $$X = -O-\underset{\underset{O}{\|}}{C}-CH_3$$

if the polymer used is an ethylene and 2-ethyl-hexyl-acrylate copolymer, $$X = -\underset{\underset{O}{\|}}{C}-O-CH_2-\underset{\underset{C_2H_5}{|}}{CH}-C_4H_9$$

The products representing constituent (A) used in the invention, present preferably the following structure:

$$CH_3-\left[(CH_2)_a-\underset{\underset{X}{|}}{CH}-(CH_2)_b\right]_p-CH=CH_2 \qquad (I)$$

in which:

a is an integer between 1 and 11, b is a number between 1 and 11, so that a+b=12;

p is a number between 3 and 30;

X is a methyl, chloride, acetate or ethyl-hexyl-acrylate group, according to the nature of the polymer described hereinabove.

Constituent (B) of the filter aid combination of the invention results in the condensation of at least one cyclic anhydride and at least one linear N-alkyl-polyamine.

The cyclic anhydrides used correspond to the following general formulae:

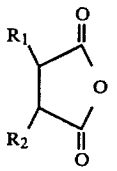

(II)

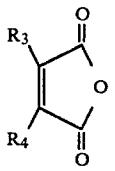

(II')

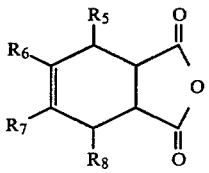

(II'')

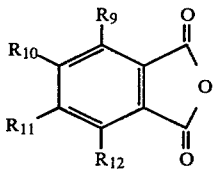

(II''')

in which $R_1$, $R_2$, $R_3$, $R_4$, $R_5$, $R_6$, $R_7$, $R_8$, $R_9$, $R_{10}$, $R_{11}$, $R_{12}$ can be different or similar, and are chosen from among the group formed from the hydrogen atom and $C_1$ and $C_5$—monovalent hydrocarbon radicals.

The linear N-alkyl-polyamines correspond to the following general formula:

$$R-\left[NH-\underset{\underset{R''}{|}}{\overset{\overset{R'}{|}}{(C)_3}}\right]_n NH_2 \qquad (III)$$

in which n represents an integer such that $0 \leqq n \leqq 3$.

R represents a saturated or unsaturated hydrocarbon chain having a number of carbon atoms between 10 and 22, R' and R'', identical or different, being chosen from among the group formed by the hydrogen atom and the $C_1$ to $C_3$—monovalent hydrocarbon radicals.

Among the linear polyamines of formula (III) used, may be mentioned, as particularly advantageous examples:

N-oleyl-1,3-diamino-propane
N-stearyl-1,3-diamino-propane
N-oleyl-1-methyl-1,3-diamino-propane
N-oleyl-2-methyl-1,3-diamino-propane
N-oleyl-1-ethyl-1,3-diamino-propane
N-oleyl-2-ethyl-1,3-diamino-propane
N-stearyl-1methyl-1,3-diamino-propane
N-stearyl-2methyl-1,3-diamino-propane
N-stearyl-1-ethyl-1,3-diamino-propane
N-stearyl-2-ethyl-1,3-diamino-propane
N-oleyl-dipropylene-triamine
N-stearyl-dipropylene-triamine
and their mixtures.

The condensation of the anhydrides of formula (II) on the amines of formula (III) with a view to obtaining compound (B) may be made without a solvent; preferably is used an aromatic hydrocarbon having a boiling point between 70° C. and 250° C., for example: toluene, xylenes, di-isopropyl-benzene, an aromatic petroleum cut having the desired distillation range.

Operating proceeds as follows: polyamine is introduced drop by drop, while maintaining the temperature between 30° C. and 80°C.; the temperature is thereafter raised to 120° C.–200° C. in order to eliminate the water formed, either by carrying along with an inert gas, such as nitrogen or argon, or by azeotropic distillation with a selected solvent. Reaction time after the addition of the polyamine is between 2 hours and 8 hours, and preferably between 3 hours and 6 hours.

According to the invention, constituents (A) and (B), such as defined hereinabove, are especially convenient for improving the cold filterability properties of average petrol distillates, especially of the cuts known as enlarged gasoil cuts, having a final distillation point above 370° C., comprised, for example, between 370 and 450° C., and of the cuts known as narrow gasoil cuts having an initial distillation point ASTM above 200° C., comprised, for example, between 220 and 230° C., with regard to which each of the constituents (A) and (B) used individually has no effect (or at least a very reduced effect). It seems, therefore, that each of constituents (A) and (B) exercise on the properties of the other a synergistic action, the mechanism of which has not been clearly set out.

In general, this action becomes noticeably evident when either constituent (A) or constituent (B) is used, with respect to constituent (B) of constituent (A) in a proportion of at least 1:100 by weight, and preferably at least 1:20 by weight.

To observe a clear improvement of the cold filterability properties of the gasoil cuts of the invention, combinations of filter aids (A) and (B), in which the weight ratio between the quantities of constituents (A) and (B) may be from 1:100 to 100:1 and preferably 1:20 to 20:1, are in general added to these gasoil cuts in overall concentrations: constituent (A)+constituent (B) from 20 to 2000g by $m^3$ gasoil, on condition that the individual concentration of each of constituents (A) and (B) is not lower than $5g/m^3$.

In certain cases, one may observe already an improvement of filterability properties for an overall concentration in filter aids (A) and (B) lower than $20g/m^3$.

However, concentrations of this order are generally insufficient to give rise to a very noticeable effect on the limiting filterability temperature.

It appears, further, that the overall optimum concentration of combinations of the filter aids of the invention is most often located in the range of 50 to 500g/m$^3$.

In order to formulate the gasoil compositions of the invention, it is possible to add constituents (A) and (B) directly to the gasoil by simple mixing operation.

It is, however, often advantageous to introduce them in the form of mother solutions previously prepared: they may otherwise be two distinct solutions in the same solvent, or in two different solvents; or a solution of two constituents. The solvent(s) can consist, for example, of solvents having an aromatic character, such as for example, toluene, xylenes, diisopropylbenzene, a petroleum cut having an aromatic character with the desired distillation range.

The mother solutions can contain, for example, 20 to 60% by weight of filter aids.

Moreover, it is remarkable to observe that the filter aids of the invention which are efficient -contrary to classic filter aids- for the enlarged cuts, i.e. those having, for example, a distillation range of 150°-370° C. and more, on the one hand, are always efficient if they are used on a narrow cut whose distillation range is, for example, 230°-360° C. and more, i.e. an enlarged cut from which the light fraction (kerosene) has been removed, and, on the other hand, simultaneously inhibit the settling of n-paraffins in the doped steady gasoils, although the n-paraffins are constituted by the heaviest fractions of the crude distillable fraction.

This result is even more surprising since it is the light fraction which exercises a very favorable influence on the filterability temperature and on the solvatation of the paraffins.

The filter aids of the invention, therefore, enable a heavy fraction of hydrocarbons to be replaced without inconvenience by a light fraction, which is very interesting from the economic point of view.

The invention will be better understood by reading the following examples, given by way of non-limitative illustration.

EXAMPLES 1 to 3

The aim of these examples is to show the efficiency on different gasoils of the filter aids of the invention, the synergistic action of the constituents of the filter aid and the inhibitory action on the compact settling of the microcrystalline paraffins in the gasoils once doped, maintained steady at low temperature.

As examples of compound (A), are mentioned in turn:

$A_1$—an ethylene polymer which has the following characteristics:

average molecular mass—2725 branching rate—9

$A_2$—an ethylene and vinyl acetate copolymer which has the following characteristics:

average molecular mass—1750 branching rate—28

As an example of compound (B) is mentioned a condensation product of maleic anhydride and N-oleyl—1,3-diamino-propane, prepared under the experimental conditions described hereinabove.

The treated gasoils have the following characteristics:

TABLE I

| Origin of the distillates | ASTM Distillation $I_p$ | ASTM Distillation $F_p$ | % distilled at 350° C. | Density at 15° C. in kg/l |
|---|---|---|---|---|
| ARAMCO CUT | 198° C. | 404° C. | 87 | 0.8417 |
| SAFANIYA CUT | 200° C. | 378° C. | 86 | 0.8500 |
| KIRKUK CUT | 193° C. | 392° C. | 87 | 0.8423 |

TABLE II

Effect of the filter aids compositions on the filterability limit temperature and indication of the synergy on each of these cuts

| Origin of the distillates/ FLT in °C. | non doped | $A_1$ | $A_2$ | B | mixture* $A_1$ + B | mixture* $A_2$ + B |
|---|---|---|---|---|---|---|
| ARAMCO CUT | +7° C. | +6 | 0 | +6 | −6 | −12 |
| SAFANIYA CUT | +4° C. | 0 | −5 | +4 | −8 | −13 |
| KIRKUK CUT | +1° C. | −1 | −4 | 0 | −7 | −10 |

*mixture comprising 240 ppm of A and 60 ppm of B

EXAMPLE 4

The aim of this example is to determine the best ratios of the two constituents of the filter aid. These constituents are described in Examples 1 to 3.

The treated gasoil is an enlarged cut obtained by distillation of a crude Aramco petroleum. It has the following characteristics:

Distillation range:

| | | |
|---|---|---|
| initial point | (IP) | 187° C. |
| final point | (FP) | 441° C. |

measured in accordance with standard ASTM D 1160.

By way of comparison, the distillation range according to the standard ASTM distillation curve is:

| | |
|---|---|
| IP = 193° C. | FP = 409° C. |

The overal concentration of the filter aid is 300 ppm. The results obtained are given in the following table:

TABLE III

| Test no 1 | Compound $A_1$ ppm | Compound B ppm | FLT* °C. |
|---|---|---|---|
| 1 | 0 | 0 | +7 |
| 2 | 300 | 0 | +3 |
| 3 | 240 | 60 | −4 |
| 4 | 180 | 120 | −4 |
| 5 | 150 | 150 | −5 |
| 6 | 120 | 180 | −3 |
| 7 | 0 | 300 | +7 |

LFT* = limiting filterability temperature

Analysis of the table hereinabove shows that the action of the filter aid is obtained in a large range of ratios of the constituents. The constituents are preferably used in a 75/25 ratio.

EXAMPLE 5

The aim of this example is to illustrate the influence of the filter aid concentration of the invention on the limiting filterability temperature of the treated gasoil.

The treated gasoil is an enlarged cut obtained by distillation of a crude Safaniya petroleum.

This cut has an initial point of 180° C. and a final point of 392° C. (classic ASTM).

The filter aid used here is a mixture of compound $A_2$ and compound B in a A/B ratio: 75/25 by weight.

TABLE IV

| Concentration in filter aid (ppm*) | 0 | 175 | 350 | 700 |
|---|---|---|---|---|
| LFT °C. | 0 | −8 | −12 | −15 |

*ppm = g/m³

EXAMPLE 6

By way of comparison, three gasoils I, II and III (whose distillation ranges according to standard ASTM D 1160 are respectively 162–462° C., 184–424° C. and 229.5° C.–359° C.) were treated by three filter aids 1, 2 and 3, at a concentration of 350 ppm. 1 and 2 correspond to the classic commercial filter aids. 3 corresponds to the filter aid of the invention. The results obtained are shown in the table overleaf.

TABLE V

| | LFT (°C.) | | |
|---|---|---|---|
| | GASOIL I | GASOIL II | GASOIL III |
| Without filter aid | +3 | +4 | −1 |
| Filter aid 1 | −1 | +2 | −1 |
| Filter aid 2 | +2 | +3 | −1 |
| Filter aid 3 | −11 | −12 | −6 |

EXAMPLE 7

The aim of this example is to illustrate the action of the filter aid on different enlarged or narrow gasoil cuts whose initial and final points have been made to vary (classic ASTM distillation curve).

TABLE VI

| GASOILS | | LFT °C. | |
|---|---|---|---|
| Distillation ranges °C. | Density at 15° C. | Non doped | 300 ppm filter aid |
| 179–384 | 0.8370 | 0 | −9 |
| 173–390 | 0.8380 | −1 | −13 |
| 178–390 | 0.8407 | +2 | −3 |
| 178–396 | 0.8420 | +2 | −6 |
| 227–360 | 0.8403 | −2 | −7 |

EXAMPLE 8

The aim of this example is to illustrate the inhibitory action of the filter aid on the settling of the n-paraffins crystallizing in the gasoil cut maintained steady at low temperature.

Three 100 cm³ test-tubes are filled with a gasoil cut whose distillation range according to the classic standard ASTM is

| IP = 193° C. | FP = 409° C. |
|---|---|

This curve is, moreover, characterized by a cloud point (the temperature at which n-paraffins begin to appear) of +11° C., by a limiting filterability temperature of +7° C. and by a flow point of −18° C.

In a first test-tube, no filter aid was introduced.

In a second test-tube, 300 ppm of a commercial filter aid was introduced. In a third test-tube, 300 ppm of a filter aid composition according to the invention was introduced.

The three test-tubes were hermetically sealed and then left at rest in a cold room at −10° C. for one week.

After seven days, the degree of settling of the precipitated paraffins was noted and is shown in the table hereunder:

TABLE VII

| Test-tube no 1 (no filter aid) | Test-tube no 2 classic commercial filter aid | Test-tube no 3 filter aid of the invention |
|---|---|---|
| 50% | 95% | 15% |

It is noted that the action of a classic filter aid accelerates the settling of gasoil paraffins studied with respect to the same non-doped gasoil, whereas the filter aid of the invention substantially delays it while improving its filter characteristics (example 4).

More generally, it must be noted that the cyclic anhydride having the general formulae II to II''' to be used according to the invention can be chosen for instance from among the succinic, maleic, himic and phthalic anhydrides as well as their alkyl derivatives.

What is claimed is:

1. A gasoil composition, comprising a major proportion of a middle distillate cut and a proportion sufficient to improve the cold filterability properties of a filter aid constituted by the mixture of a constituent A and a constituent B, in which: constituent A is a member selected from the group consisting of an ethylene polymer, a halogenated ethylene polymer, a copolymer of ethylene and a monomer, and a hydrogenated butadiene and isoprene copolymer, constituent B is a condensation product of at least one cyclic anhydride and at least one N-alkyl-polyamine of the formula:

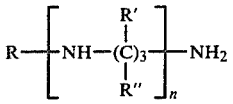

in which $0 \leqq n \leqq 3$

R represents a saturated or unsaturated alkyl chain having between 10 and 22 carbon atoms, R' and R'' can be identical or different and are either a hydrogen atom or a $C_1$ to $C_3$-monovalent hydrocarbon radical.

2. A composition according to claim 1, wherein the weight ratio between the quantities of constituents A and B is from 1:100 to 100:1 and their overall concentrations are from 20 to 2000g per m³ of the middle distillate cuts, on condition that the individual concentration of each of constituents A and B is not lower than 5g/m³.

3. A composition according to claim 2, wherein the weight ratio between the quantites of constituents A and B is from 1:20 to 20:1.

4. A composition according to claim 2 or 3, wherein the overall concentration of constituents A and B is from 50 to 500g/m³ of the said middle distillate cut.

5. A composition according to claim 1, 2 or 3, wherein the average molecular mass of constituent A is between 500 and 15 000.

6. A composition according to claim 1, 2 or 3, wherein constituent A has the following average general formula:

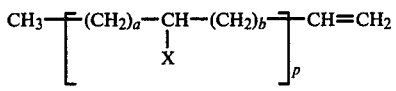

in which a is a number between 1 and 11 b is a number between 1 and 11 so that a+b=12 p is a number between 3 and 30.

x is a group of

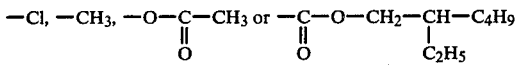

according to the nature of the chosen polymer.

7. A composition according to claim 1, 2 or 3, wherein the cyclic anhydride, which gives rise to the formation of compound B after condensation on N-alkyl polyamine as described in claim 1 has the general formula:

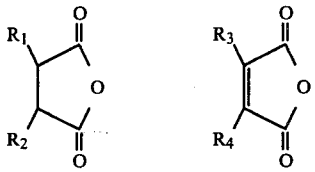

-continued

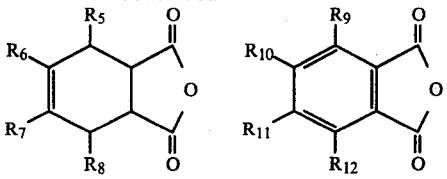

in which radicals $R_1$ to $R_{12}$ each represent a group having a hydrogen atom or a $C_1$ to $C_5$-monovalent hydrocarbon radical.

8. A composition according to claim 7, wherein the cyclic anhydride is chosen from the group consisting of the succinic anhydrides, maleic anhydrides, himic anhydrides and phthalic anhydrides as well as their alkyl derivatives.

9. A composition according to claim 1, wherein the said linear polyamine is chosen from the group consisting of:

N-oleyl-1,3-diamino-propane
N-stearyl-1,3-diamino-propane
N-oleyl-1-methyl-1,3-diamino-propane
N-oleyl-2-methyl-1,3-diamino-propane
N-oleyl-1-ethyl-1,3-diamino-propane
N-oleyl-2-ethyl-1,3-diamino-propane
N-stearyl-1-methyl-1,3-diamino-propane
N-stearyl-2-methyl-1,3-diamino-propane
N-stearyl-1-ethyl-1,3-diamino-propane
N-stearyl-2-ethyl-1,3-diamino-propane
N-oleyl-dipropylene-triamine
N-stearyl-dipropylene-triamine
and their mixtures.

10. A composition according to claim 1, 2, 3 or 9, wherein said gasoil cut is an elongated cut and has a final ASTM distillation point above 370° C.

11. A composition according to claim 1, 2, 3 or 9, wherein said gasoil cut is a narrow cut and has an ASTM initial distillation point between 200° C. and 230° C.

12. A composition according to claim 10, wherein the said gasoil cut has a final distillation point between 390° C. and 450° C.

13. A composition according to claim 11, wherein the said gasoil cut has an initial ASTM distillation point at least equal to 200° C.

* * * * *

UNITED STATES PATENT AND TRADEMARK OFFICE

CERTIFICATE OF CORRECTION

PATENT NO. : 4,367,074

DATED : January 4, 1983

INVENTOR(S) : Maldonado et al.

It is certified that error appears in the above-identified patent and that said Letters Patent is hereby corrected as shown below:

In the title, after "temperature" 2nd occurrence insert --storage--

Column 4, line 12: insert -- - -- before "methyl" to read --1-methyl-- line 13: insert -- - -- before "methyl" to read --2-methyl-- line 53: "of" should read --or--.

Signed and Sealed this

Third Day of April 1984

[SEAL]

Attest:

GERALD J. MOSSINGHOFF

Attesting Officer

Commissioner of Patents and Trademarks